United States Patent [19]

Dalrymple et al.

[11] Patent Number: 4,892,042

[45] Date of Patent: Jan. 9, 1990

[54] COMBINATION BOTTOM OUTLET SADDLE AND SUMP

[75] Inventors: Thomas H. Dalrymple, Crown Point, Ind.; Philip J. Daum, Chicago, Ill.; Walter T. Croson, Hammond, Ind.

[73] Assignee: Union Tank Car Company, East Chicago, Ill.

[21] Appl. No.: 285,107

[22] Filed: Dec. 15, 1988

[51] Int. Cl.[4] ..... B61D 5/00

[52] U.S. Cl. ..... 105/362

[58] Field of Search ..... 105/236, 358, 362, 260; 417/38; 141/35

[56] References Cited

U.S. PATENT DOCUMENTS

| | | |
|---|---|---|
| 1,369,111 | 2/1921 | Jacobs et al. . |
| 4,184,663 | 1/1980 | Rollins et al. . |
| 4,220,097 | 9/1980 | Wempe et al. . |
| 4,234,159 | 11/1980 | Rollins et al. . |
| 4,237,928 | 12/1980 | Messersmith . |
| 4,394,002 | 7/1983 | Polley . |
| 4,397,444 | 8/1983 | Behle . |
| 4,422,473 | 12/1983 | Polley . |
| 4,431,162 | 2/1984 | Carlson . |
| 4,460,155 | 7/1984 | Smith . |
| 4,461,397 | 7/1984 | Portis . |
| 4,527,489 | 7/1985 | Schlink . |
| 4,697,528 | 10/1987 | Rehbein . |

OTHER PUBLICATIONS

Drawing No. 21018 entitled "Saddle, Washout & Sump Machining".

Drawing No. 74386 entitled "Top Unload Assembly 3", Siphon 1 Air.

Drawing No. 89491 entitled "Fittings Assembly 110 ¼", I.D. Tank Dot 111A-100W3.

*Primary Examiner*—Andres Kashnikow

*Assistant Examiner*—Virna L. Mojica

*Attorney, Agent, or Firm*—Dressler, Goldsmith, Shore, Sutker & Milnamow, Ltd.

[57] ABSTRACT

A combination bottom outlet saddle and sump is provided for a railway tank car. The saddle member comprises an upper surface which conforms to the underside of the tank body and is attached thereto in surrounding relationship with an outlet opening formed in the tank body. An opening is formed through the saddle member in fluid communication with the outlet opening. A sump is recessed into the upper surface of the saddle member longitudinally spaced a short distance from the saddle member opening in fluid communication with the outlet opening. A bottom outlet valve is mounted to the lower surface of the saddle member in fluid communication with the saddle member opening. A recessed channel may be provided in the upper surface of the saddle member to permit fluid communication between the sump and the saddle member opening. A skid assembly surrounds the entire saddle member.

8 Claims, 2 Drawing Sheets

12
14
24
28
30
32
34
36
38
39
40
42
4
5
6

COMBINATION BOTTOM OUTLET SADDLE AND SUMP

BACKGROUND OF THE INVENTION

1. Field of the Invention

This invention generally relates to bottom outlet saddle devices and sump devices for use in railway tank cars generally used for carrying various liquid ladings. More particularly, this invention relates to a combination bottom outlet saddle and sump device used to attach an outlet valve to the bottom of a tank car and to collect residual lading during draining of the tank car.

2 Description of the Prior Art

It has heretofore been known to provide combination bottom outlet valve saddle and skid devices to the bottom of tank cars. Examples of such devices are shown in U.S. Pat. Nos. 4,184,663; 4,234,159; 4,237,928; and 4,394,002.

It has also heretofore been known to locate a sump adjacent to a bottom outlet valve and to utilize a common skid assembly to protect both the sump and the bottom outlet valve. An example of such a device is disclosed in U.S. Pat. No. 4,220,097.

However, none of these prior art devices utilize a single-piece, integrally cast or machined, combination bottom outlet saddle and sump arrangement.

SUMMARY OF THE INVENTION

In accordance with a preferred embodiment of the invention, a saddle member is provided having a sump formed integrally therewith which is attached to the underside of a tank car in fluid communication with the outlet opening at the bottom of the tank body. A suitable bottom outlet valve is attached to the saddle member. A skid assembly is provided in surrounding relationship to the saddle member.

The saddle member comprises an upper surface which conforms to the underside of the tank body and is attached thereto in surrounding relationship with the outlet opening at the bottom of the tank body. An opening is formed through the saddle member in fluid communication with the outlet opening. A sump is recessed into the upper surface of the saddle member longitudinally spaced a short distance from the saddle member opening in fluid communication with the outlet opening for receipt of residual lading thereinto. A mounting means is formed on the lower surface of the saddle member for receipt of a bottom outlet valve thereto in fluid communication with the saddle member opening. The saddle member may be provided with a recessed channel to direct residual lading collected in the sump into the saddle member outlet opening.

A skid assembly surrounds the entire saddle member for protection of the saddle member and outlet valve assembly.

The saddle member is preferably cast or machined from an alloy, such as stainless steel material, whereas the skid assembly may be made from a less expensive material, such as carbon steel.

DESCRIPTION OF THE PREFERRED EMBODIMENT

While this invention is susceptible of embodiment in many different forms, this invention and the accompanying drawings disclose only one specific form as an example of the use of the invention. The invention is not intended to be limited to the embodiment so described, and the scope of the invention will be pointed out in the appended claims.

Some of the figures illustrating the preferred embodiment of the apparatus show structural details and mechanical elements that will be recognized by one skilled in the art. However, the detailed descriptions of some of these elements are not necessary to an understanding of the invention and, accordingly, are not herein presented.

Figure 1:
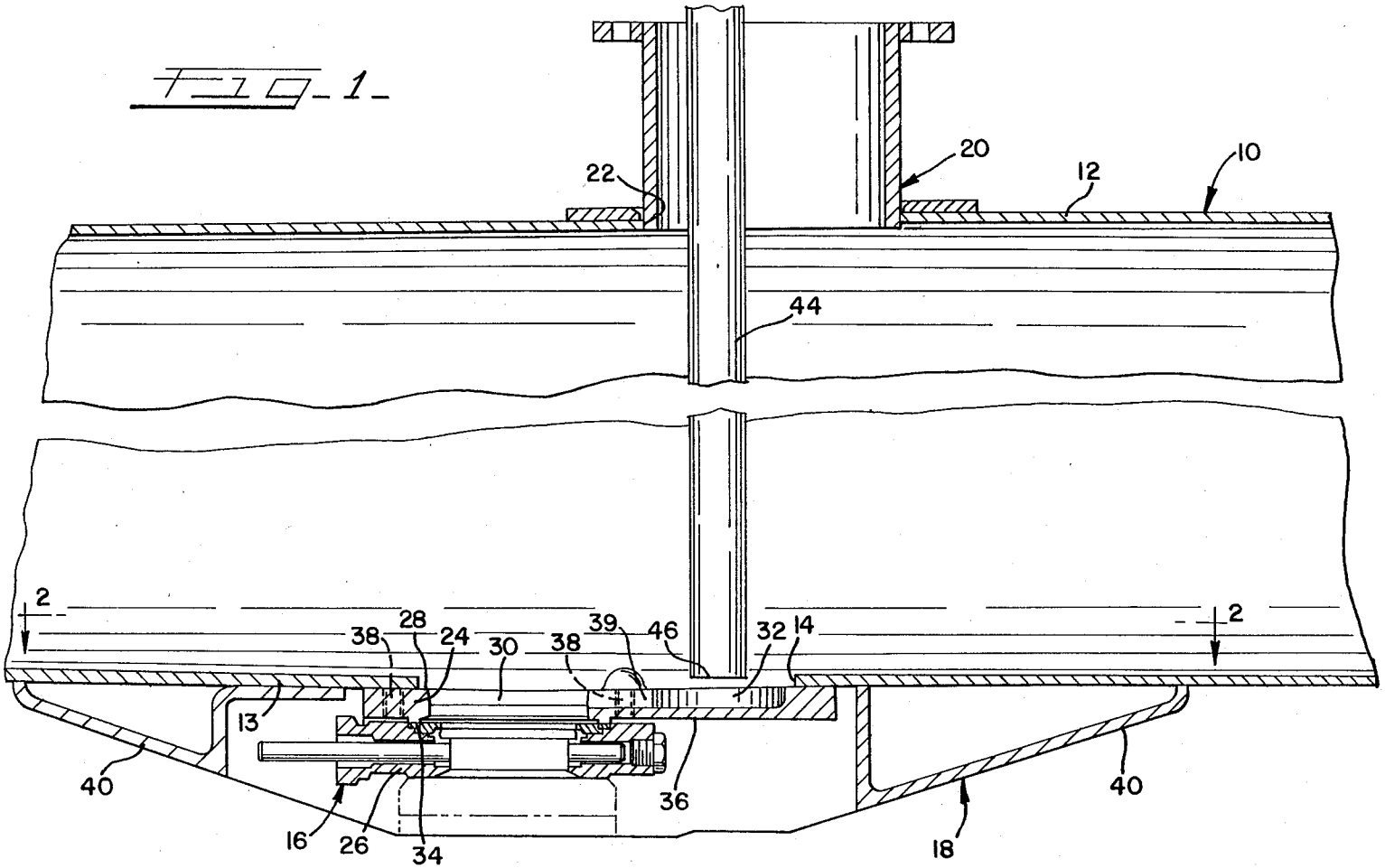
FIG. 1 is a vertical section view, partially broken-away, of the center portion of a typical railway tank car having a combination bottom outlet valve saddle and sump arrangement constructed in accordance with the present invention attached thereto.
Figures 2, 3, 4, 5, 6:
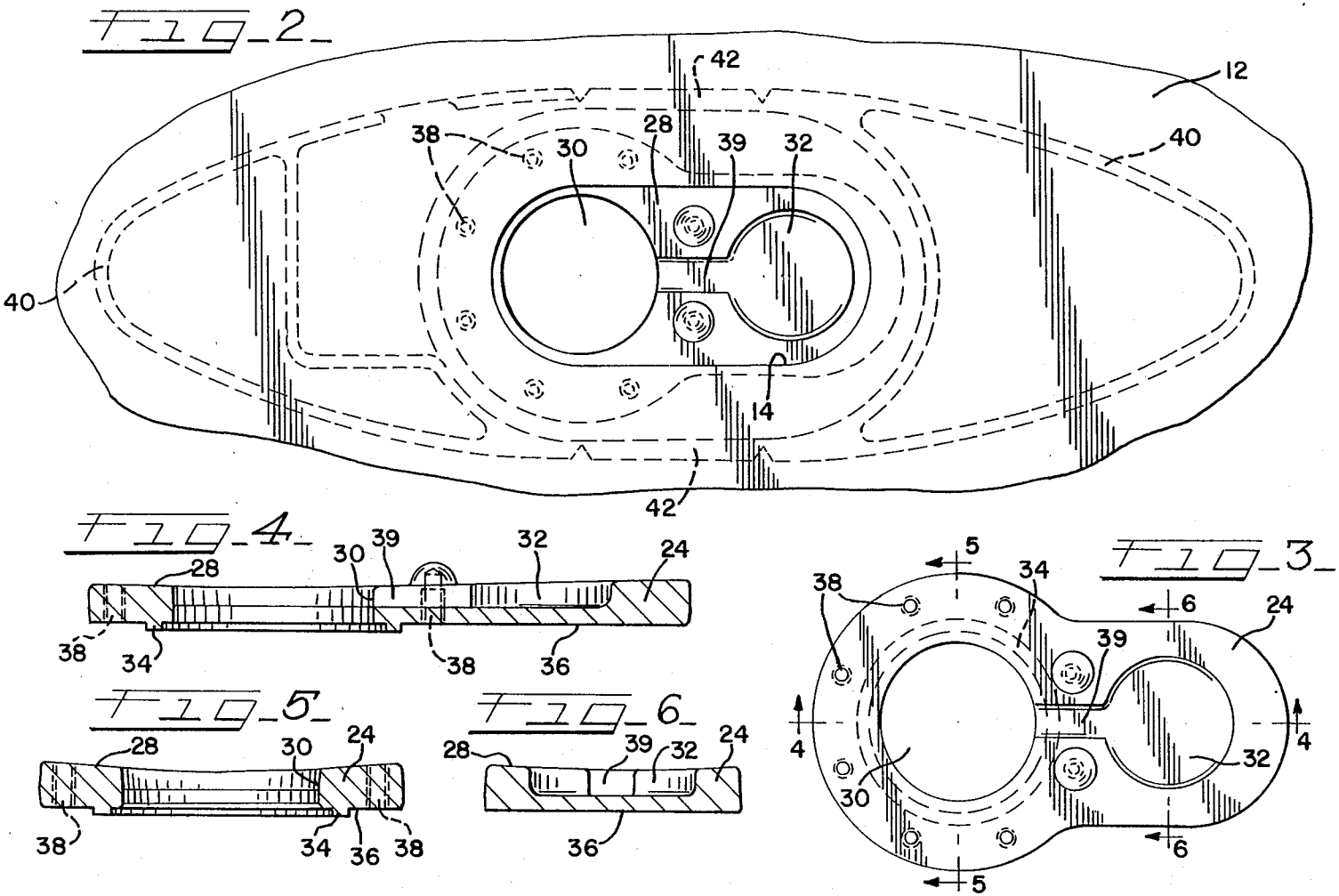
FIG. 2 is a partial section view taken along line 2—2 in FIG. 1.
FIG. 3 is a top plan view of the combination bottom outlet valve saddle and sump arrangement constructed in accordance with the present invention.
FIG. 4 is a section view taken along line 4—4 in FIG. 3.
FIG. 5 is a section view taken along line 5—5 in FIG. 3.
FIG. 6 is a section view taken along line 6—6 in FIG. 3.

Referring to FIG. 1, a central portion of a railway tank car of well-known construction is generally indicated at 10 as having a tank body portion 12. The tank body portion 12 is hollow for receiving a liquid lading thereinto. The bottom of the tank body has an outlet opening 14 formed therein for withdrawal of liquid lading therethrough. The outlet opening 14 is covered by a saddle and outlet valve assembly 16. A skid assembly 18 is attached to the underside of the tank body in surrounding relationship to the saddle and outlet valve assembly 16. A nozzle 20 communicates with an opening 22 formed in the top of the tank body. The tank body 12 may be constructed in such a manner that the tank bottom 13 slopes downward from the ends of the tank toward the center at which point the valve assembly 16 is located.

The saddle and outlet valve assembly 16 comprises a saddle member 24 and a bottom outlet valve 26. The saddle member 24 serves to secure the outlet valve 26 to the tank body 12 in fluid communication with outlet opening 14.

The present invention is directed to an improved saddle member arrangement which also functions as a sump for receipt of residual thereinto during drainage of the lading from the tank body.

Referring to FIGS. 1–6, in accordance with a preferred embodiment of the invention, saddle member 24 comprises a generally flat, elongated, integrally formed member having an upper surface 28 shaped to conform with the underside of tank body 12. Saddle member 24 is suitably secured about its periphery to the tank body as by welding. An opening 30 is formed in saddle member 24 adjacent one end thereof. A sump 32 is defined by a recessed portion formed in upper surface 28 adjacent the other end of saddle member 24 and spaced a short distance from opening 30. As best seen in FIG. 1, opening 30 and sump 32 are positioned immediately below and in fluid communication with outlet opening 14.

A standard AAR tongue-and-groove mounting flange 34 extends from the lower surface 36 of saddle member 24 to accept a suitable outlet valve 26 in a well-known manner. While the outlet valve 26 shown in FIG. 1 in solid lines is a typical butterfly valve bottom outlet, the saddle member also accepts bottom outlet ball valves as indicated in phantom lines. A plurality of spaced-apart threaded bores 38 are formed in saddle member 24 around opening 30 for receipt of suitable fasteners (not shown) therein for securing outlet valve 26 to the saddle member 24.

In accordance with a preferred embodiment of the invention, particularly if saddle member 24 is used in conjunction with a butterfly valve, a channel 39 is recessed into upper surface 28 of saddle member 24 and extends between opening 30 and sump 32 so as to drain residual lading collected in sump 32 into opening 30. The bottom surface of sump 32 and channel 39 may slope downward to opening 30 to enhance drainage.

Saddle member 24 is surrounded by skid assembly 18. Skid assembly 18 comprises skid member 40 of suitable configuration which surrounds the respective ends of the saddle member 24. Connecting plates 42 are utilized to extend the length of the skid assembly.

Referring to FIG. 1, a conventional siphon pipe 44 extends downwardly from nozzle 20 into tank body 12. Siphon pipe 44 has a lower end 46 positioned a short distance above sump 32. Liquid lading from tank body 12 may be top unloaded through siphon pipe 44 in a well-known manner.

In accordance with a feature of the invention, the relatively small saddle member 24 may be cast from relatively expensive alloys, such as stainless steel, and the larger skid assembly 18 is preferably fabricated from a less expensive material, such as carbon steel. The prior art single-piece saddle/skid and sump/skid combinations do not permit such cost savings.

The combination bottom outlet valve saddle and sump arrangement of the present invention permits the bottom outlet valve and the sump to be located close together. In contrast, when a separate sump is used, it must be moved some distance away from the center of the tank body (up the slope toward the end of the tank), thus resulting in a larger residual volume in the tank body when unloading is through the siphon pipe. The invention also provides complete drainage of the lading from the sump 32 into the outlet opening 30 when channel 39 is present. Further, the sump being open and accessible on the bottom may be easily heated, either separately or in conjunction with the outlet valve, by welding a steam heating chamber (not shown) to its bottom.

It will be readily observed from the foregoing detailed description of the invention and from the illustrated embodiment thereof that numerous variations and modifications may be effected without departing from the true spirit and scope of the novel concepts or principles of this invention.

What is claimed is:

1. In a tank car bottom outlet valve assembly, a combination bottom outlet valve saddle and sump arrangement for attachment to the underside of a tank car in fluid communication with an outlet opening therein, comprising: an integral saddle member having an upper surface shaped to conform to the underside of said tank car for attachment thereto in surrounding relationship with said outlet opening, said saddle member having an opening formed therein in fluid communication with said outlet opening, a sump integrally formed and recessed into the upper surface of said saddle member longitudinally spaced a short distance from said opening in said saddle member in fluid communication with said outlet opening for receipt of residual lading thereinto, and mounting means formed on a lower surface of said saddle member for mounting a bottom outlet valve thereto in fluid communication with said opening.

2. The invention as defined in claim 1 wherein a channel is recessed into the upper surface of said saddle member which extends between said opening and said sump for draining residual lading collected in said sump into said opening.

3. The invention as defined in claim 1 wherein said saddle member is a single-piece casting.

4. The invention as defined in claim 1 wherein said saddle member is surrounded by a skid assembly attached to the underside of said tank car.

5. The invention as defined in claim 4 wherein said skid assembly comprises a pair of spaced-apart skid members which surround the respective ends of said saddle member and connecting members which extend therebetween on opposite sides of said saddle member.

6. The invention as defined in claim 3 wherein said saddle member is made of stainless steel.

7. The invention as defined in claim 1 wherein the bottom end of a siphon pipe extends downwardly adjacent said sump.

8. The invention as defined in claim 4 wherein said skid assembly is made of carbon steel.

* * * * *